US006142169A

United States Patent [19]

Lees et al.

[11] Patent Number: 6,142,169

[45] Date of Patent: Nov. 7, 2000

[54] STERILE TANK VENTING SYSTEM FOR A FILLING MACHINE

[75] Inventors: John N. Lees, Minneapolis; Jonathan P. Buesing, Maplewood, both of Minn.

[73] Assignee: Tetra Laval Holdings & Finance, SA, Pully, Switzerland

[21] Appl. No.: 08/829,505

[22] Filed: Mar. 28, 1997

[51] Int. Cl.[7] ..... B08B 9/027; B67C 3/22; B65B 31/06; B65B 55/18

[52] U.S. Cl. ..... 137/240; 137/206; 137/209; 137/241; 141/67; 141/90; 141/91; 141/129; 141/167; 141/172; 141/198; 222/64; 222/148; 222/399; 134/98.1; 134/102.1; 134/102.2; 134/166 C; 134/171

[58] Field of Search ..... 137/209, 206, 137/238, 241, 240, 625.4, 187, 192, 197, 199, 202; 222/399, 394, 61, 64, 148; 141/67, 39, 90, 91, 129, 167, 192, 198; 134/98.1, 182.1, 102.2, 166 C, 171

[56] References Cited

U.S. PATENT DOCUMENTS

| | | | |
|---|---|---|---|
| 3,385,473 | 5/1968 | Forcesi | 137/209 |
| 3,788,341 | 1/1974 | Athy, Jr. et al. | 137/209 |
| 4,064,898 | 12/1977 | Petersen et al. | 137/240 |
| 4,143,793 | 3/1979 | McMillin et al. | 222/61 |
| 4,169,486 | 10/1979 | Otteman et al. | 137/240 |
| 4,253,480 | 3/1981 | Kessel et al. | 137/487.5 |
| 4,413,752 | 11/1983 | McMillin et al. | 222/61 |
| 4,450,981 | 5/1984 | Haig | 222/64 |
| 4,485,840 | 12/1984 | Erwin | 137/240 |
| 4,554,942 | 11/1985 | Williams et al. | 137/240 |
| 4,613,060 | 9/1986 | Ulbrich et al. | 222/61 |
| 4,644,967 | 2/1987 | Wyatt et al. | 60/39.3 |
| 4,979,527 | 12/1990 | Mueller et al. | 134/166 C |
| 4,989,649 | 2/1991 | Weiler et al. | 137/241 |
| 4,994,180 | 2/1991 | Sims et al. | 222/399 |
| 5,009,339 | 4/1991 | Hanerus et al. | 222/380 |
| 5,090,440 | 2/1992 | Ladouceur et al. | 137/209 |
| 5,137,047 | 8/1992 | George | 137/240 |
| 5,176,189 | 1/1993 | Perchthaler et al. | 141/98 |
| 5,353,830 | 10/1994 | Mochizuki et al. | 137/240 |
| 5,462,078 | 10/1995 | Andenmatten et al. | 137/240 |

*Primary Examiner*—George L. Walton
*Attorney, Agent, or Firm*—Welsh & Katz, Ltd.

[57] ABSTRACT

A gas supply system connected to vent a tank of a product filling system is set forth. The gas supply system comprises a high pressure/low pressure gas supply having a common outlet. The high pressure/low pressure gas supply is operable in a first mode of operation in which high pressure gas is supplied at the common outlet and a second mode of operation in which low pressure gas is supplied at the common outlet. A sterile filter having an inlet and an outlet is also provided. A steam supply system is disposed in-line between the common outlet of the high pressure/low pressure gas supply and the sterile filter. A tank valve system is provided having an inlet in fluid communication with the outlet of the sterile filter. The tank valve system also has first and second outlets and is operable in a first mode of operation in which the inlet is placed in fluid communication with the first outlet and a second mode of operation in which the inlet is placed in fluid communication with the second outlet. A product tank having a vent in fluid communication with the second outlet of the tank valve system is also provided. The product tank is used to provide a supply of product for use in the fill system when the fill system is in a production cycle of operation. The gas supply system is operable in an autoclaving mode of operation in which steam is supplied by the steam supply system and in which the high pressure/low pressure gas supply and the tank valve system are operated in their respective first modes of operation to autoclave the sterile filter. The gas supply system is also operable in a production mode of operation in which the high pressure/low pressure gas supply and the tank valve system are operated in their respective second modes to thereby vent the product tank.

12 Claims, 3 Drawing Sheets

STERILE TANK VENTING SYSTEM FOR A FILLING MACHINE

BACKGROUND OF THE INVENTION

Packaging machines are known that integrate into a single unit the various components necessary to form a container, fill the container with a liquid product, and seal the container. Such packaging machines typically feed carton blanks into the machine, seal the bottoms of the cartons, fill the cartons with a product dispensed from a product storage tank, seal the tops of the cartons, and off-load the filled cartons for shipping.

As the product is dispensed from the product tank during the packaging process, compensation must be made for the displacement of the product in the product tank. Thus, it is desirable to vent the product tank in order to compensate for the displacement of the product. Where the product is a liquid foodstuff, it may be necessary to maintain a sterile environment in the tank. Therefore, the tank cannot be vented to the open atmosphere.

One solution to the problem of venting the product tank while maintaining a sterile environment in the product tank is set forth in U.S. Pat. No. 5,009,339 to Hanerus et al. The '339 patent illustrates an apparatus for venting a plant for filling containers. The apparatus includes two control valves disposed at an outlet from the product tank and a vacuum pipe and pump assembly provided along an upper edge of the product tank.

Although a product tank can be vented in this manner at conventional operating speeds, new problems are presented as packaging machines are designed for ever increasing through put capacities. Additionally, such a venting system falls short of the increasing sterility demands placed on these machines.

BRIEF SUMMARY OF THE INVENTION

A gas supply system connected to vent a tank of a product filling system is set forth. The gas supply system comprises a high pressure/low pressure gas supply having a common outlet. The high pressure/low pressure gas supply is operable in a first mode of operation in which high pressure gas is supplied at the common outlet and a second mode of operation in which low pressure gas is supplied at the common outlet. A sterile filter having an inlet and an outlet is also provided. A steam supply system is disposed in-line between the common outlet of the high pressure/low pressure gas supply and the sterile filter. A tank valve system is provided having an inlet in fluid communication with the outlet of the sterile filter. The tank valve system also has first and second outlets and is operable in a first mode of operation in which the inlet is placed in fluid communication with the first outlet and a second mode of operation in which the inlet is placed in fluid communication with the second outlet. A product tank having a vent in fluid communication with the second outlet of the tank valve system is also provided. The product tank is used to provide a supply of product for use in the fill system when the fill system is in a production cycle of operation. The gas supply system is operable in an autoclaving mode of operation in which steam is supplied by the steam supply system and in which the high pressure/low pressure gas supply and the tank valve system are operated in their respective first modes of operation to autoclave the sterile filter. The gas supply system is also operable in a production mode of operation in which the high-pressure/low pressure gas supply and the tank valve system are operated in their respective second modes to thereby vent the product tank.

DETAILED DESCRIPTION OF THE INVENTION

Figure 1:
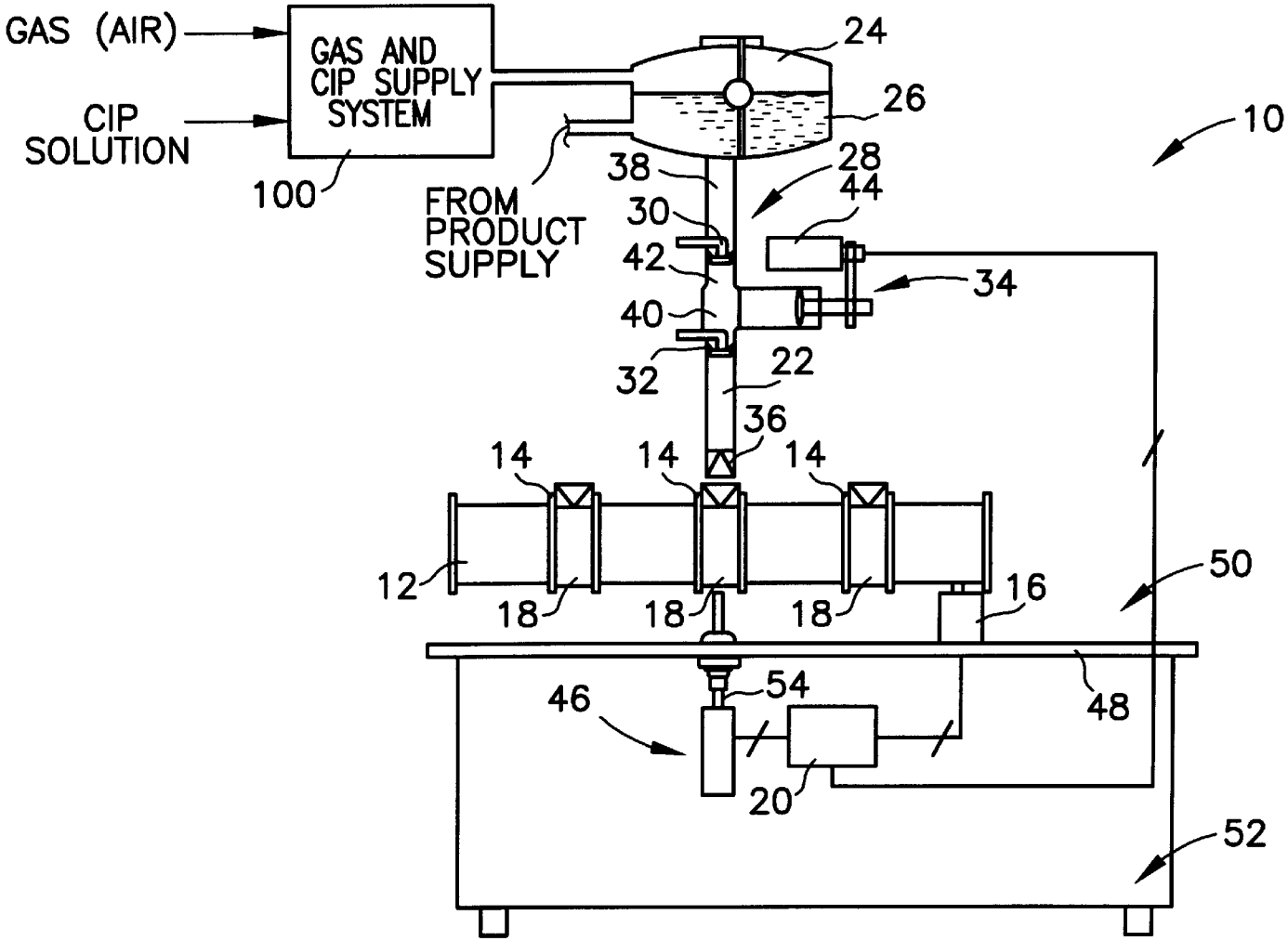
FIG. 1 is a partial diagram of one embodiment of a fill system that may incorporate the gas supply system of the present invention.

FIG. 1 is a partial diagrammatic view of one of the many types of filling systems, shown generally at 10, that may utilize the improved tank venting system described herein. As shown in FIG. 1, a conveyer 12 carrying a plurality of container support members 14 is driven, for example, by a motor 16, such as a servomotor. The support members 14 each are adapted to support a single, open topped container 18 with its bottom already sealed. The motor 16 is driven under the control of, for example, a programmable control system 20, or the like, to present the containers 18 successively below a fill pipe 22 of the system 10.

A storage or balance tank 24 containing a product 26, such as a liquid product, is connected to provide a flow of the product 26 through a flow control system 28. The flow control system 28, generally stated, comprises an inlet valve 30, an outlet valve 32, a pump mechanism 34, the fill pipe 22, and a nozzle 36. The inlet valve 30 is preferably arranged as part of a product inlet pipe 38. Similarly, the outlet valve 32 is preferably arranged as part of the fill pipe 22. The inlet valve 30 and outlet valve 32 are operated by the programmable controller 20 to control the flow of the liquid product 26 into and from a pump head cavity 40 of a pump head 42 of the pump mechanism 34. The pump mechanism 34 may be any type of pump, such as one disclosed in U.S. Pat. No. 4,877,160, or one such as disclosed in U.S. Pat. No. 5,913,665, both of which are hereby incorporated by reference. The pump mechanism 34 may be driven, for example, by a servomotor 44 under the direction of the programmable control system 20.

As illustrated, the containers 18 are successively positioned below the nozzle 36 for introduction of the liquid product 26 into the container 18. Each container 18 is preferably lifted upward so that the nozzle 36 is disposed within the interior of the container 18. This lifting is preferably done using a lifting mechanism 46 that executes a motion profile under the direction of the programmable control system 20. The flow control system 28 then fills the container 18 with liquid product 26 while the container 18 is simultaneously lowered from the nozzle 36 by the lifting mechanism 46, preferably maintaining the nozzle 36 below the level of the liquid product 26 throughout the downward motion to eliminate frothing.

During a production cycle of the machine 10 the volume of product in the tank 24 fluctuates. To compensate for this fluctuation, the machine 10 is provided with a gas and CIP supply system 100. The system 100 maintains aseptic conditions in the tank 24 by keeping the pressure therein at a positive gauge at all times during the production cycle. To this end, the system 100 supplies sterile air to the tank 24 when the volume of product is decreasing and relieves excess pressure by allowing excess air to escape from the tank 24 when the volume of product is increasing.

The system 100 also functions during a CIP cycle of the machine 10. During cleaning and sterilizing of the fill system, it is advantageous to inject air into the tank 24 to keep the level of CIP liquid below a predetermined level, and to urge the CIP liquid from the system after cleaning and disinfecting. Air or other gas injected into the tank in any of the foregoing processes must be sterile.

Figure 2:
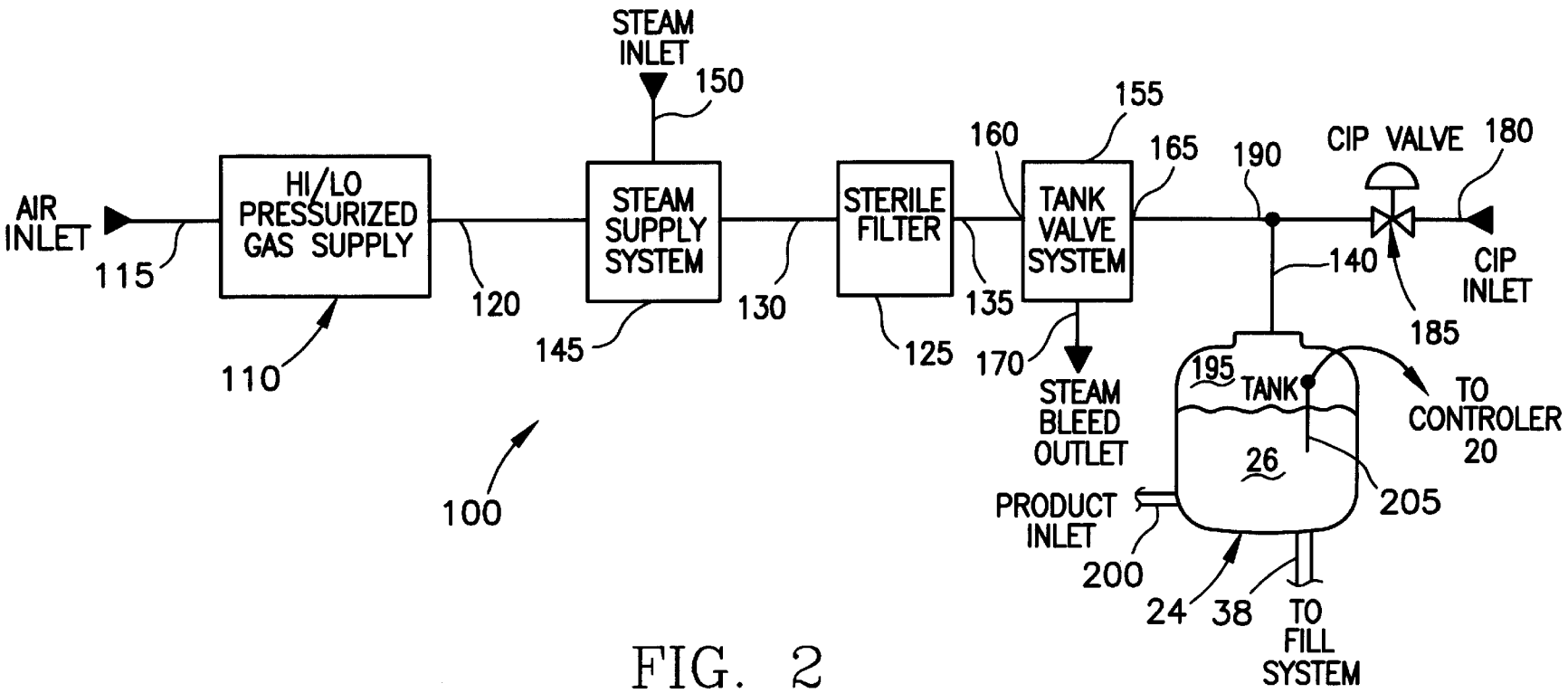
FIG. 2 is a block diagram of one embodiment of the gas supply system of the present invention.

With reference to FIG. 2, there is shown one embodiment of a vent and CIP supply system 100. As illustrated, the system 100 comprises a high/low pressurized gas supply 110 having an inlet 115 for receiving a gas, such as air. The gas received at inlet 115 is preferably at high pressure, for example, at 5 BAR. The high/low pressurized gas supply also comprises a common outlet 120. The supply 110 is operable in a first mode of operation in which the gas received at inlet 115 is provided as a high-pressure gas at the common outlet 120. Such high pressure gas is preferably provided at between 2 and 3 BAR guage. In a second mode of operation, the gas received at inlet 115 is provided as a low-pressure gas at the common outlet 120. Such low pressure gas is preferably provided at between 2.5 and 10 kPa-guage. Preferably, the high/low pressurized gas supply 110 is controlled to switch between the first and second modes of operation by the control system 20 which communicates with the supply 110 through one or more conductors (not illustrated).

The supply system 100 is also provided with a sterile filter 125 having an inlet 130 and an outlet 135. The sterile filter 125 functions to sterilize the gas provided from the common outlet 120 to the inlet 140 of the tank 24.

Occasionally, it becomes necessary to sterilize the sterile filter 125. To this end, a steam supply system 145 is provided. In the illustrated embodiment, the steam supply system 145 is disposed in-line between the common outlet 120 of the high/low pressure gas supply and the inlet 130 of the sterile filter 125. The steam supply system 145 also comprises a steam inlet 150 that is connected to a source of high-temperature steam (not illustrated).

A tank valve system 155 is disposed to control the flow of gas from the sterile filter 125 to the tank 24. The tank valve system 155 includes an inlet 160 that is in fluid communication with the outlet 135 of the sterile filter 125. A first outlet 165 of the tank valve system 155 is in fluid communication with the inlet 140 of the tank 24. A second outlet 170 of the tank valve system 155 is in fluid communication with a steam bleed outlet or vent.

The system 100 is also provided with a CIP inlet 180 through which a CIP solution is provided to the tank 24 during cleaning. A valve 185 is disposed to control the flow of any gas or other fluid between line 140 and the CIP inlet 180.

Tank 24 comprises an inlet 140 in fluid communication with line 190 and opens to the headspace 195 above the product 26. Product is provided to the tank 24 through inlet 200 and proceeds therefrom to the product flow control system 28. The tank 24 is further provided with a level sensor 205 which communicates the level of product in the tank 24 to the controller 20 that, in turn, controls pumps and/or valves (not illustrated) that replenish the tank 24 with product through inlet 200 to maintain the product level at a predetermined constant level.

Figure 3:
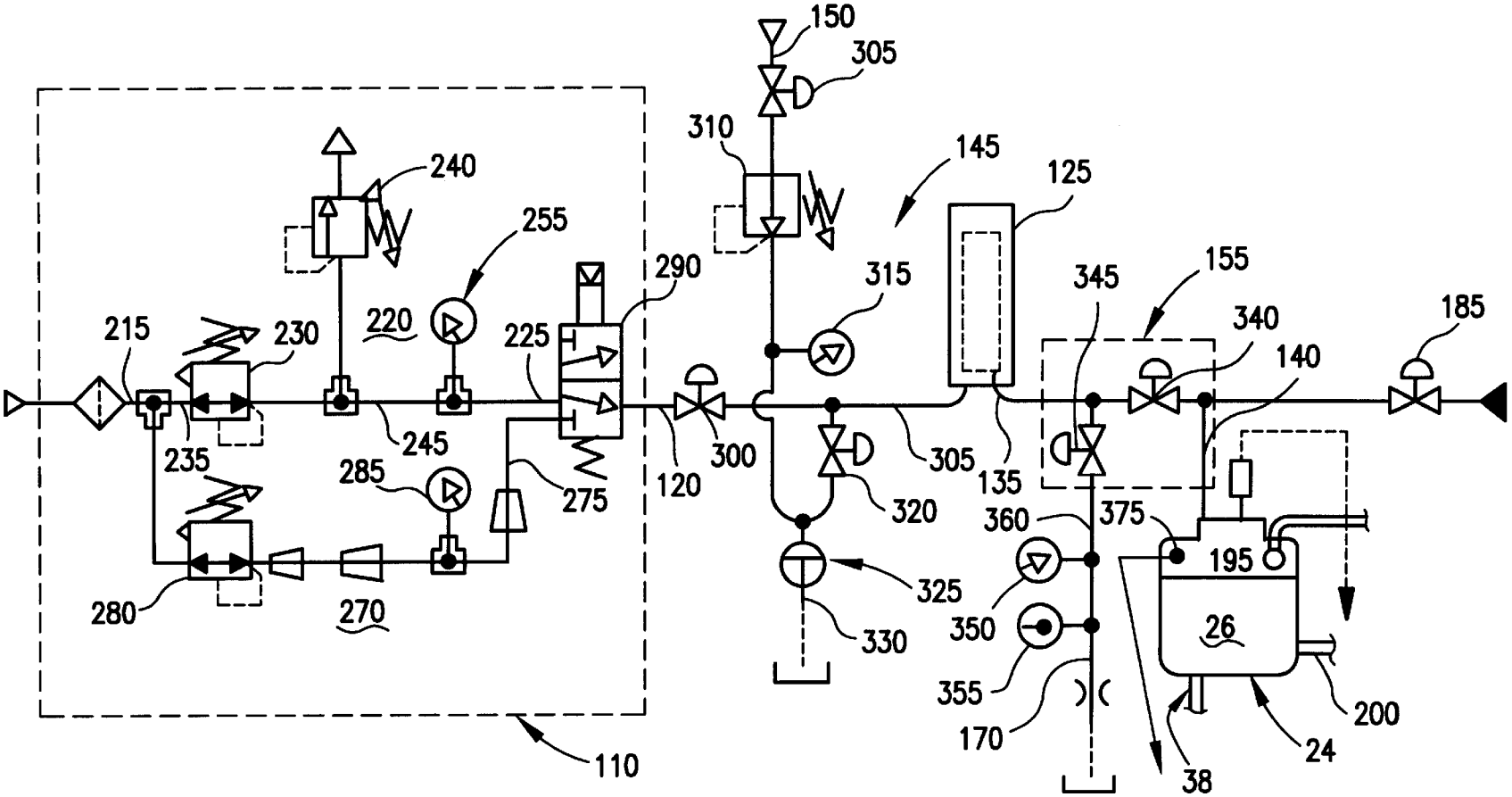
FIG. 3 is a schematic diagram of one embodiment of the present invention.

With reference to FIG. 3, there is shown one embodiment of the gas supply system 100. More particularly, FIG. 3 illustrates one embodiment of each of the high/low pressurized gas supply 110, the steam supply system 145, the sterile filter 125, and the tank valve system 155.

The illustrated embodiment of the high/low pressurized gas supply 110 comprises a common inlet 215 for connecting to a source of gas at high pressure. The supply 110 also comprises a low-pressure regulated path, shown generally at 220 that is connected to accept the gas received at the common inlet 215. The low-pressure regulated path 220 provides a supply of gas at low pressure at outlet line 225. To effect this operation, the low-pressure regulated path 220 includes a low-pressure regulator 230 in fluid communication with the common inlet 215. The low-pressure regulator 230 reduces the pressure of the gas received at its input line 235 to a predetermined low-pressure value and provides the low-pressure gas at line 225. A pressure relief valve 240 is provided in line 245 in fluid communication with the outlet of the low pressure regulator 230 and functions to vent the gas from the low pressure regulated path 220 when the low pressure regulator output 230 measured line 245 exceeds the predetermined low pressure value. A gauge 255 is also provided to monitor the pressure in the low pressure regulated path 220. The gauge 255 can provide a direct visual read-out to an operator or, alternatively, provide an electronic signal (analog or digital) which is monitored and/or displayed by the control system 20.

A high-pressure regulated path, shown generally at 270, is also connected to accept the gas at the common inlet 215. The high-pressure regulated path 270 provides a supply of gas at high pressure at outlet line 275. To this end, a high-pressure regulator 280 is provided that has its input in fluid communication with the common inlet 215 and provides a high-pressure gas output on line 275. As in the low-pressure regulated path 220, the high-pressure regulated path 270 is provided with a gauge 285 that monitors the pressure in the path 270. The gauge 285 can provide a direct visual read-out to an operator or, alternatively, provide an electronic signal (analog or digital) which is monitored and/or displayed by the control system.

Outlet line 225 and outlet line 275 are in fluid communication with respective inlets of a gas switch 290. The gas switch 290 through-connects either high pressure gas from the high pressure regulated path 270 or low pressure gas from the low pressure regulated path 220 to the common outlet 120. Preferably, the determination as to which of the high pressure or low pressure paths are through-connected is under the control of the control system 20 and is based on one or more operator inputs.

The common outlet 120 of the gas supply system 110 is provided to the input of the steam supply system 145. As illustrated, the steam supply system 145 comprises a valve 300 disposed between common outlet 120 and a line 305 that controls whether gas flows from the gas supply 110 and the steam supply system 145. Steam inlet 150 is connected to an external source of steam (not illustrated) and is supplied to the rest of the system through a steam inlet valve 305. A steam pressure reducing valve 310 is disposed to receive steam from the steam valve 305 and is followed by a steam gauge 315 that measures the pressure of the steam in the steam supply system 145. Ultimately, the steam of the steam supply system 145 is provided to the inlet of the sterile filter 125 through a further steam outlet valve 320. Steam that has condensed to the liquid state is trapped in a steam trap 325 having an outlet 330 from which the liquid may be removed from the system.

The outlet 135 of the sterile filter 125, as noted above, is provided to the inlet of a tank valve system 155. In the illustrated embodiment, the tank valve system 155 comprises a first valve 340 that is disposed to control any flow of gas, steam, etc. from the outlet of the sterile filter 125 to the inlet 140 of the tank 24. A second valve 345 is disposed to control any flow of gas, steam, etc. from the outlet of the sterile filter 125 to the steam bleed outlet 170. A steam gauge 350 and a steam thermocouple 355 are disposed to monitor the steam pressure and steam temperature, respectively, as it exits the line 360 leading to the steam bleed outlet 170.

In a production cycle of the foregoing apparatus, a gas, such as air, is supplied from the low-pressure regulated path 220 through the gas switch 290 and through the sterile filter 125. The valve 300 of the steam supply system 145 is open and steam inlet valve 305 and steam outlet valve 320 are closed. The tank valve system 155 is operated to open valve 340 and close valve 345. When the volume of product in the tank 24 is decreasing, sterile air flows into the tank 24 from the low-pressure regulated path 220 and through the sterile filter 125. When the volume of product in the tank 24 is increasing, air flows out of the tank 24, back through the sterile filter 125, and is vented to, for example, atmosphere through the pressure relief valve 240. The control system 20 monitors tank pressure with the pressure transducer 375. If the pressure is too low, (e.g., below atmospheric pressure) sterility is assumed to have been compromised and production is stopped. At that time, the sterile filter 125 must be autoclaved, and the fill system 10 must be cleaned and disinfected before production is resumed.

In the foregoing system, the sterile filter 125 may be autoclaved in place. The sterile filter 125 must be autoclaved when the filter cartridge is changed, when the compressed air supply has been interrupted, and whenever the fill system has been opened or otherwise compromised. To begin the autoclave process, valves 300 and 320 are closed. The tank valve system 155 is closed to the tank 24 and open to the steam bleed outlet 170. Thus, valve 340 is closed while valve 345 is open. Steam inlet valve 150 is opened and condensate is purged from the system through the steam trap 325. After the condensate has been purged, valve 320 is opened, and steam is allowed to flow through the sterile filter 125 and, therefrom, through the steam bleed outlet 170. After the system has heated up, it is held at a minimum of 121° C. for at least 15 minutes. This can be achieved with steam at 1.05 bar (gauge). The control system 20 monitors the steam temperature as determined by the signal that the control system receives from the steam thermocouple 355 and the steam pressure as determined by the signal received from the steam gauge 350. The received signals and/or their corresponding values are used to control the duration of the autoclave cycle.

Upon completion of the autoclave cycle, valves 305 and 320 are closed while valve 300 is opened. The high/low pressurized gas supply provides high-pressure gas at the common outlet 120. To this end, the gas switch 290 is switched so that it through-connects the gas received from the high-pressure path 270. The pressurized gas flows through the sterile filter 125 and out to atmosphere through the steam bleed outlet 170. After the system has dried, the tank valve system 155 closes off the steam bleed outlet 170 by closing valve 345 and the high/low pressurized gas supply 110 is switched to provide the gas at low pressure at the common outlet 120.

Autoclaving of the filter 125 generally does not take place during fill system cleaning, because the gas supply system 100 may be called upon to supply gas to the tank 24 during such cleaning. Additionally, the fill system must be sterilized after filter autoclaving before a subsequent production cycle can begin.

During a CIP cycle of operation of the fill system 10, a CIP solution is supplied through valve 185 to the tank 24. Often, gas in the tank 24 becomes entrained in the CIP solution thereby resulting in a rise of the level of the CIP solution in the tank 24. If the level of the CIP solution reaches a certain maximum level, cleaning and disinfecting can be inhibited.

To counter this rise in the CIP solution level, the high/low pressurized gas system 110 provides high-pressure gas at the common outlet 120. Valve 300 is opened while valves 305 and 320 are closed. The tank valve system 155 closes off the steam bleed outlet 170 and valve 340 is also closed to prevent the gas from reaching the tank 24. When the level of CIP solution, as measured by sensor 205, reaches and/or exceeds a predetermined level, the tank valve system 155 is operated to allow a flow of the high pressure, sterile gas to the tank 24. This flow assists in forcing the CIP solution from the tank 24.

When the fill system 10 is neither in a production or cleaning mode of operation, the valves of the gas supply system 100 are set as they are during a production cycle. The tank 24 is thus charged with sterile air and a positive gauge pressure is maintained. This pressure is monitored by, for example, a pressure gauge disposed within the tank 24 and/or by the gauge 255. The resulting signal is monitored by, for example, the control system 20. Whenever the pressure in the tank 24 drops below a predetermined threshold value, the sterility of the systems 10 and 100 are assumed to have been compromised. As such, the systems 10 and 100 must undergo a cleaning cycle and the sterile filter 125 must be autoclaved.

It will be recognized that the foregoing gas supply system can be incorporated in virtually any type of product supply system, particularly liquid product supply systems. The system illustrated and described in connection with FIG. 1 is merely exemplary of one of the many types of product supply systems that may utilize the gas supply system described herein.

Numerous modifications may be made to the foregoing system without departing from the basic teachings thereof. Although the present invention has been described in substantial detail with reference to one or more specific embodiments, those of skill in the art will recognize that changes may be made thereto without departing from the scope and spirit of the invention as set forth in the appended claims.

What is claimed is:

1. In a filling machine having a supply tank for storing product, a gas supply system for supplying a pressurized gas to the supply tank comprising:

a common inlet for connecting to a source of gas at a high pressure;

a low pressure regulated path connected to accept the gas received at the common inlet, the low pressure regulated path having an outlet at which gas is available at a low pressure, the low pressure regulated path being configured for supplying a low pressure gas for pressurizing a space in the supply tank, above the product, for discharging the product;

a high pressure regulated path connected to accept the gas received at the common inlet, the high pressure regulated path having an outlet at which gas is available at high pressure, the high pressure regulated path being configured for supplying a high pressure gas for cleaning;

a gas switch connected to receive gas from the outlet of the low pressure regulated path and the outlet of the high pressure regulated path and for through-connecting either high pressure gas or low pressure gas to a common outlet for supply to the supply tank;

a filter disposed to filter the gas supplied to the common inlet; and a steam supply system disposed between the common outlet of the gas switch and an inlet of the supply tank, the steam supply system including a steam inlet, a first steam valve connected to receive steam from the steam inlet, a pressure reducing valve connected to receive steam from the first steam valve, a steam trap connected to receive steam from the pressure reducing valve, and a second steam valve disposed to control flow of steam from the pressure reducing valve ,the steam being supplied for cleaning at least one of the filter and the supply tank, wherein the high pressure regulated path, the low pressure regulated path, gas switch and steam supply system are configured to cooperate with each other to store and supply product from the supply tank and to clean the supply tank.

2. A filling machine as claimed in claim 1 wherein the filter is a carbon filter.

3. A filling machine as claimed in claim 1 wherein the low pressure regulated path comprises:

a low pressure regulator connected to receive the gas from the common inlet, the low pressure regulator having an output at which the gas is provided at a predetermined low pressure value;

a pressure relief valve connected to vent the gas from the low pressure regulated path when the pressure at the low pressure regulator output exceeds the predetermined low pressure value silent.

4. A filling machine as claimed in claim 3 and further comprising a low pressure gauge connected to monitor pressure within the low pressure regulated path and to provide an output indicative of the monitored pressure.

5. A filling machine as claimed in claim 1 wherein the high pressure regulated path comprises a high pressure regulator connected to receive the gas from the common inlet, the high pressure regulator having an output at which the gas is provided at a predetermined high pressure value.

6. A filling machine as claimed in claim 5 and further comprising a high pressure gauge connected to monitor pressure within the high pressure regulated path and to provide an output indicative of the monitored pressure.

7. A filling machine as claimed in claim 1 wherein the steam supply system further comprises a third steam valve disposed to control flow of steam between the outlet of the gas switch and the common line.

8. A filling system as claimed in claim 1 and further comprising a sterile filter connected to filter a gas flow from the common line to the supply tank.

9. A filling system as claimed in claim 8 wherein the steam supply system further comprises:

a fourth valve connected to control a gas flow from the outlet of the sterile filter to the tank; and a fifth valve connected to control a gas flow from the outlet of the sterile filter to a vent.

10. A gas supply system connected to vent a tank of a product filling system, the gas supply system comprising:

a high pressure/low pressure gas supply having a common outlet, the high pressure/low pressure gas supply being operable in a first mode of operation in which high pressure gas is supplied at the common outlet for cleaning the tank and a second mode of operation in which low pressure gas is supplied at the common outlet for discharging a product from the tank;

a sterile filter having an inlet and an outlet;

a steam supply system in-line between the common outlet of the high pressure/low pressure gas supply and the sterile filter the steam supply configured to supply steam to the tank for cleaning;

a tank valve system having all inlet in fluid communication with the outlet of the sterile filter, the tank valve system having first and second outlets, the tank venting system being operable in a first mode of operation in which the inlet is placed in fluid communication with the first outlet and a second mode of operation in which the inlet is placed in fluid communication with the second outlet;

a product tank having a vent in fluid communication with the second outlet of the tank valve system;

the gas supply system being operable in an autoclaving mode of operation in which steam is supplied by the steam supply system for cleaning and in which the high pressure/low pressure gas supply and the tank valve system are operated in their respective first modes of operation to autoclave the sterile filter, the gas supply system also being operable in a production mode of operation in which the high pressure/low pressure gas supply and the tank valve system are operated in their respective second modes to thereby vent the product tank.

11. A gas supply system as claimed in claim 10 wherein the high pressure/low pressure gas system is responsive to an automatic control system to select between the first and second modes of operation thereof.

12. A gas supply system as claimed in claim 10 wherein the tank valve system is responsive to an automatic control system to select between the first and second modes of operation thereof.

* * * * *